US006742635B2

(12) United States Patent
Hirshberg

(10) Patent No.: US 6,742,635 B2
(45) Date of Patent: Jun. 1, 2004

(54) SPORTS BAG INCLUDING AN ATTACHED MAT

(75) Inventor: Jonathan Hirshberg, Playa del Rey, CA (US)

(73) Assignee: JR286 Inc., Los Angeles, CA (US)

( * ) Notice: Subject to any disclaimer, the term of this patent is extended or adjusted under 35 U.S.C. 154(b) by 505 days.

(21) Appl. No.: 09/745,762

(22) Filed: Dec. 20, 2000

(65) Prior Publication Data

US 2002/0074251 A1 Jun. 20, 2002

(51) Int. Cl.[7] ..... A47C 17/82; A47C 19/22
(52) U.S. Cl. ..... 190/2; 224/576
(58) Field of Search ..... 190/2, 1, 8, 11, 190/12 R, 109; 224/576, 577, 153, 155, 156, 653; 383/4, 113; 206/315.1

(56) References Cited

U.S. PATENT DOCUMENTS 4,068,786 A * 1/1978 Taniguchi ..... 224/6
4,154,323 A * 5/1979 Sneider ..... 190/2
4,164,275 A * 8/1979 Davis ..... 190/2
4,194,601 A * 3/1980 Yellin ..... 190/2
D287,667 S * 1/1987 Cathcart et al. ..... D3/42
D376,689 S * 12/1996 Doppelt ..... D3/274
D378,953 S * 4/1997 Pavlik ..... D3/233
5,649,658 A * 7/1997 Hoffman et al. ..... 224/576
5,785,219 A * 7/1998 Kraft ..... 224/576

FOREIGN PATENT DOCUMENTS

GB 2061712 * 5/1981 ..... 190/2

* cited by examiner

*Primary Examiner*—Lien Ngo
(74) *Attorney, Agent, or Firm*—Thomas I. Rozsa; Tony D. Chen

(57) ABSTRACT

A sports bag which is defined to include any carrying bag such as a duffel bag, backpack, gym bag or other bag which is used to carry articles such as sports equipment, a thermos, sports clothing etc, which includes a mat which is conveniently stored inside the sports bag when not in use and can be removed through an opening in the sports bag to permit the mat to be extended transverse to the sports bag so that it provides a flat surface on which the user may rest or place articles. The mat can be permanently affixed to the sports bag or it can be removably affixed and attached by means of fasteners such as male and female mating hook and loop fasteners, snaps, etc. The mat can be rolled up and stored within the sports bag when not in use and unrolled and laid flat adjacent the sports bag when in use.

13 Claims, 2 Drawing Sheets

SPORTS BAG INCLUDING AN ATTACHED MAT

BACKGROUND OF THE INVENTION

1. Field of the Invention

The present invention relates to the field of bags for carrying articles. More particularly, the present invention relates to the field of bags such as duffel bags, sports bags and backpacks, which can be used to carry sports items such as sports clothing, athletic shoes, and related items used during an athletic event.

2. Description of the Prior Art

In general, sports bags for carrying articles used in sporting events are well known in the prior art. However, none of the bags known in the prior art include a feature which allows the bag to be converted into a convenient pillow for the user to rest and sleep while having the upper portion of the user's body on a surface off the ground, or to be converted into a surface on which the user can place articles, tie his shoes, etc.

With conventional sports bags, if the user wishes to take a rest, he may use the bag itself as a pillow but is forced to lie on the ground unless the user remembered to bring a towel to place under his body while using the sports bag as a pillow. In addition, the user must bring a towel or other separate flat article to lay on the ground if the user wishes to place sports articles on a surface other than the grass, dirt, or other ground surface where the athletic event is taking place.

Therefore, it is desirable and there is a significant need for a sports bag or backpack which is used to carry sports articles to include a means to provide a flat surface which can be used as a surface on which to lay or a surface on which articles can be placed or a surface for the user to tie his shoes.

SUMMARY OF THE INVENTION

The present invention is a sports bag which is defined to include any carrying bag such as a duffel bag, backpack, gym bag or other bag which is used to carry articles such as sports equipment, a thermos, sports clothing, etc., which includes a mat which is conveniently stored inside the sports bag when not in use and can be removed through an opening in the sports bag to permit the mat to be extended transverse to the sports bag so that it provides a flat surface on which the user may rest or place articles. The rollout mat can be permanently affixed to the sports bag or it can be removably affixed and attached by means of fasteners such as male and female mating hook and loop fasteners, snaps, etc. In the preferred embodiment, the mat is a rollout mat which can be rolled up and stored within the sports bag when not in use and unrolled and laid flat adjacent the sports bag when in use.

It is an object of the present invention to provide a sports bag which includes a storable mat which can be rolled up and stored inside the sports bag when not in use and then unrolled and caused to extend from the sports bag and laid adjacent the sports bag when in use.

It is a further object of the present invention to provide a means to permanently attach the mat within the sports bag and have the mat in a folded or rolled up condition when stored inside the sports bag and further provide an opening through which the mat can be removed and placed in use while still having a portion of the mat attached to the sports bag.

It is an additional object of the present invention to provide a means by which the mat can be removably affixed within the sports bag so that the mat can be removed and cleaned and thereafter reattached for use.

It is another object of the present invention to provide a compartment within the sports bag by which the mat is segregated from the remainder of the interior of the sports bag and further provide a means to enclosed the mat within the compartment and thereafter provide a means to create an opening through which the mat can be removed and placed in position for use.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
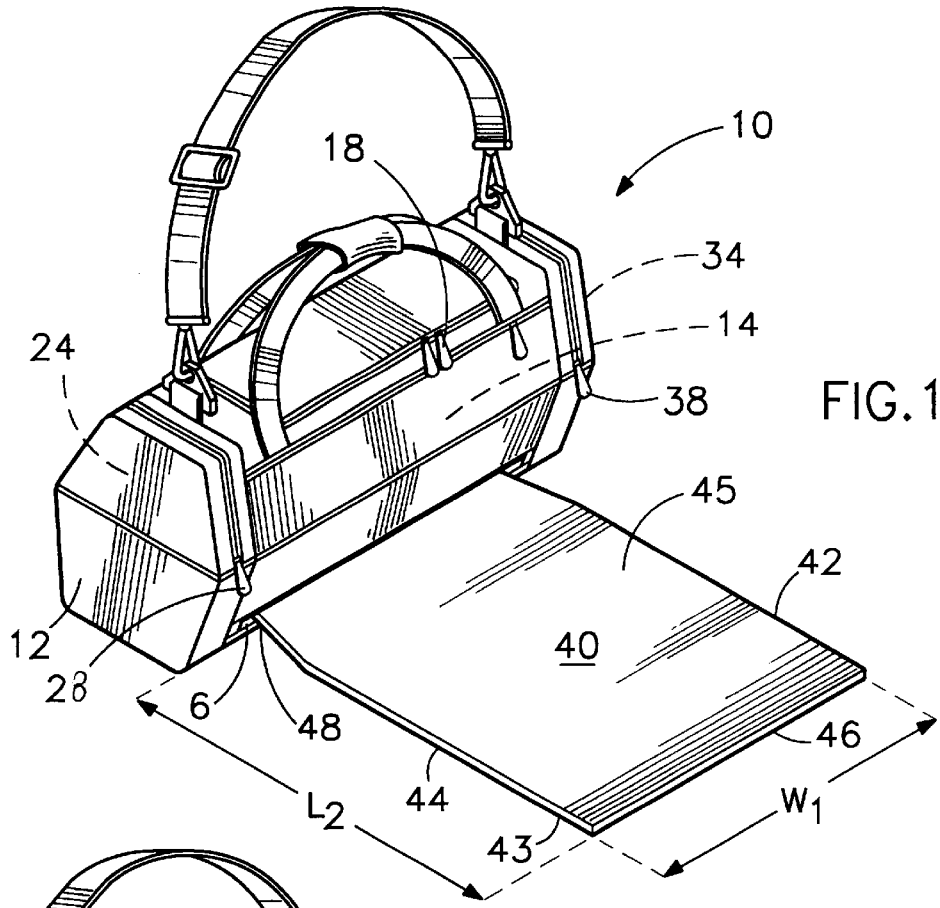
FIG. 1 is a perspective view of the preferred embodiment of the present invention sports bag which includes the present invention attached mat permanently attached to the sports bag with the mat in the unfolded condition.
Figure 2:
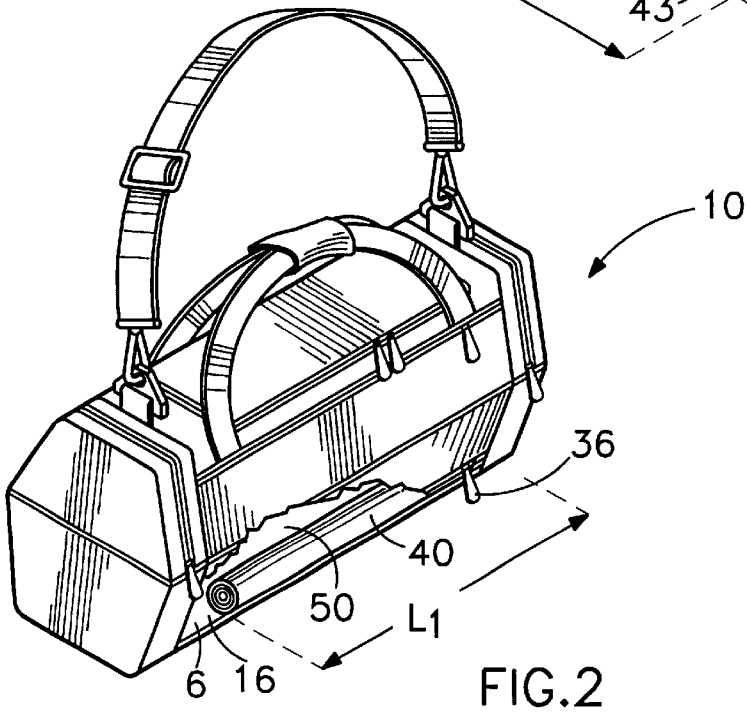
FIG. 2 is a perspective view of the present invention sports bag with a portion of the exterior broken away to show the present invention attached mat in the folded or rolled-up condition within the bag.

Referring to FIGS. 1 and 2, there is shown at 10 a sports bag which contains the present invention mat 40. For purposes of illustration only, the sports bag 10 which is illustrated in FIGS. 1 and 2, and is an athletic bag generally in the shape of a duffel bag. For purposes of the discussion in this description and the appended claims, "sports bag" is defined to include a gym bag, backpack, and any other type of carrying bag which is used to carry articles, especially articles related to participating in an athletic event such as swimming, track and field, weight lifting, exercise, bicycle riding, etc.

The sports bag 10 includes an exterior surface 12 and at least one interior compartment 14 for housing the articles to be carried within the sports bag. Access to the interior of the sports bag 12 can be gained by at least one opening means 18, which in the case of the sports bag illustrated in FIG. 1 is a multiplicity of zippers which permit the sports bag 10 to be opened so that a portion of the surface 12 can be folded away from the remainder of the surface 12 to gain access to the interior 14 of the bag. In the case of the specific sports bag 10 illustrated in FIG. 1, there are also a pair of side pocket interior chambers 24 and 34 to which access is gained by opening means 28 and 38 respectively. For the purposes of the present invention, the interior of the bag 14 is the portion which houses the present invention rollout mat 40.

The mat 40 as illustrated in FIG. 1 is of a generally rectangular configuration, having a pair of oppositely disposed lengthwise edges 42 and 44, a front edge 46 and a rear edge 48. The mat 40 is permanently affixed to the interior of the sports bag 10 by having the rear edge 48 permanently affixed to one interior surface 16 of the sports bag 10. The preferred means of permanent attachment is stitching. However, it will be appreciated that other means of permanent attachment such as gluing are within the spirit and scope of the present invention.

Figure 4:
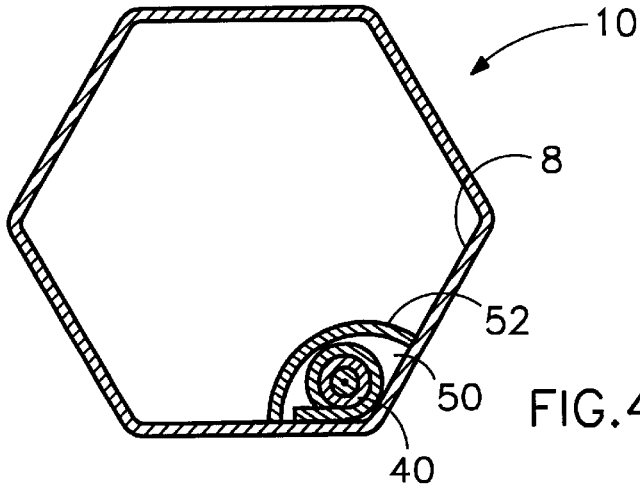
FIG. 4 is a cross-sectional view of the alternative embodiment of the present invention illustrated in FIG. 3, with the present invention mat in the folded or rolled-up condition within the compartment of the sports bag.

A preferred option of the present invention is to house the rollout mat 40 within a separate interior compartment 50 within the interior 14 of the sports bag 10 so that the rollout mat 40 is segregated from the rest of the interior of the sports bag One possible segregating means 52 is illustrated in the cross-sectional view of FIG. 4 and comprises a flexible wall sewn into portions of the interior surface 8 of sports bag 10 to create the interior compartment 50 within which the rollout mat 40 is housed. It will be appreciated that the dividing wall 52 is an option and the rollout mat 40 can be housed within the general interior compartment 14.

When in use as illustrated in FIG. 1, the mat 40 is unfolded or rolled out from the interior compartment through an opening 6 in the exterior surface 12 which is created by opening means 36 which by way of example is a zipper. The zipper 36 is moved to the open position as illustrated in both FIGS. 1 and 2 so that the mat 40 can be rolled out or unfolded to the open or usable condition as illustrated in FIG. 1. Since the mat 40 is permanently affixed to the sports bag 10, the mat provides an adjoining horizontal surface. The lower surface 43 of the mat 40 is placed on the ground or other surface onto which the sports bag 10 is placed and the upper surface 45 of the mat 40 is available for use. The user can lie down on the mat so that his/her head rests on the sports bag 10 which is used as a pillow and the upper portion of the user's body rests on the upper surface 45 of the mat 40 so that the user does not have his/her upper torso on dirt, grass, or other ground cover. Additionally, the upper surface 45 can be used to rest articles on such as athletic shoes, a thermos, athletic equipment, etc. By way of example only, if the length $L_1$ of the sports bag is approximately 26 inches, then the width $W_1$ of the mat 40 can be 17 ½ inches and the length $L_2$ of the mat 40 can be 30 inches. It will be appreciated that the dimensions are merely illustrative and the mat can be any desired length and width.

In the preferred embodiment, the mat 40 is rolled up when not in use as illustrated in FIG. 2. While rolling up the mat is the most conventional method for storage, it will be appreciated that the mat 40 can be folded or placed into the interior compartment 14 (whether or not it has its own separate compartment 50) in any desired manner.

In the preferred embodiment, the mat 40 is made of the same material as the sports bag 10. The sports bag 10 is preferably made out of flexible synthetic material such as nylon, rayon, or any other synthetic material and could also be made out of fabric material such as cloth or leather. The mat 40 can also be made out of any comparable material.

Figure 3:
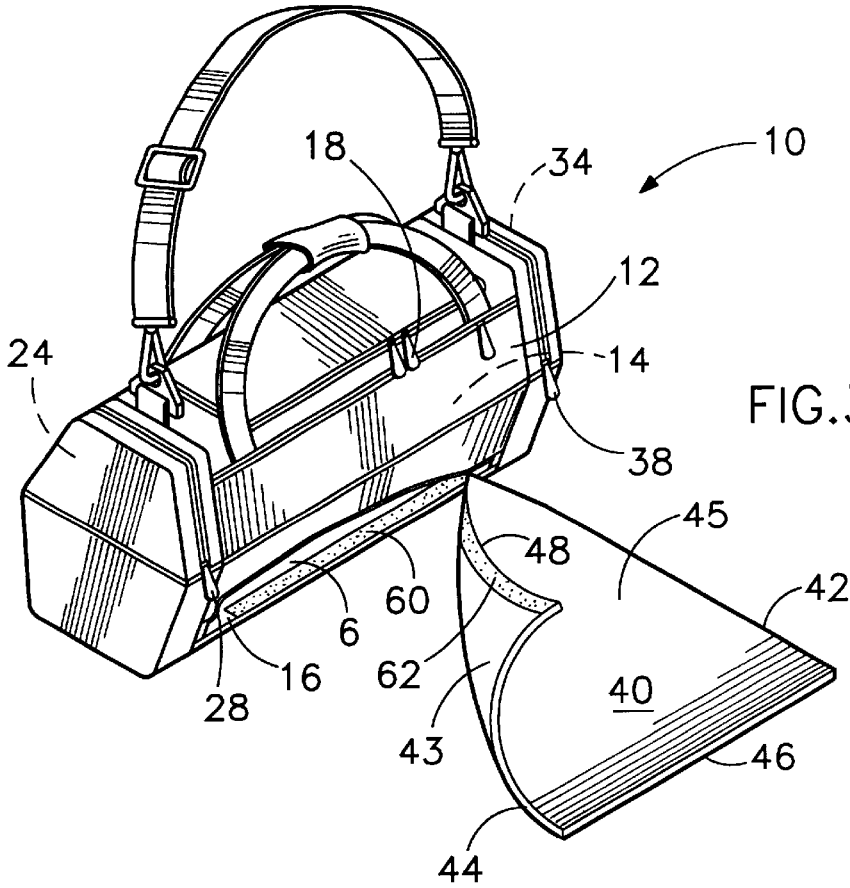
FIG. 3 is a perspective view of an alternative embodiment of the present invention sports bag which includes the present invention mat removably attached to the sports bag with the mat in the unfolded condition and partially removed to show the attachment means.

Referring to FIGS. 3 and 4, there is illustrated an alternative embodiment of the present invention. The sports bag 10 and its component as well as the mat 40 are the same as in the first embodiment of FIGS. 1 and 2 and are therefore numbered the same. The only difference is the method of attachment of the mat 40 to the interior of the sports bag. Whereas in the preferred embodiment, the mat 40 was permanently affixed to an interior surface 16 of the sports bag 10, in the alternative embodiment illustrated in FIGS. 3 and 4, the mat 40 is removably affixed to the interior surface 16. Referring to FIG. 3, there is illustrated a pair of hook and loop fasteners, with one fastener 60 attached to the interior surface 16 of sports bag 10 and the other fastener 62 attached to the lower surface 43 of the mat 40 adjacent the rear end 48. By way of example the fasteners illustrated have a female loop fastener on surface 16 and a male hook fastener on lower surface 43. Alternatively, the male hook fastener can be on surface 16 and the female loop fastener on surface 43. Further alternatively, the fasteners can be mating snap members or any other fasteners known in the art which permits the mat 40 to be removably attached to the sports bag 10. By having the mat removable, it can be placed at a location remote from the sports bag and further can be removed and separately washed.

Defined broadly, the present invention is a sports bag comprising: (a) an exterior surface and an interior compartment having an interior surface; (b) the exterior surface having at least one opening leading to the interior compartment; and (c) a mat affixed to a portion of the interior surface so that the mat can extend out of the interior compartment through the at least one opening in the exterior surface and be positioned to lay flat adjacent the sports bag; (d) whereby the mat can be rolled-up or folded up to be retained within the sports bag when not in use and can be unrolled or unfolded and extend through the opening in the exterior surface of the sports bag when in use.

Defined in greater detail, the present invention is a sports bag comprising: (a) an exterior surface and an interior compartment having an interior surface; (b) the exterior surface having at least one opening leading to the interior compartment; (c) means to open and close the at least one opening in the exterior surface; (d) a mat affixed to a portion of the interior surface so that the mat can extend out of the interior compartment through the at least one opening in the exterior surface and be positioned to lay flat adjacent the sports bag; (e) an interior dividing wall to segregate the mat from the remainder of the interior of the sports bag when the mat is contained within the sports bag; (f) whereby the mat can be rolled-up or folded up to be retained within the sports bag when not in use and can be unrolled or unfolded and extend through the opening in the exterior surface of the sports bag hen in use.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A sports bag comprising:

a. an exterior surface made of material and a first large interior compartment for retaining sports items, the first large interior compartment extending for a given interior length and having an interior surface;

b. said exterior surface having a first, opening leading to the first large interior compartment;

c. means to open and close said first opening in said exterior surface leading to said first large interior compartment;

d. a second interior compartment retained within said first large interior compartment, extending for substantially the same length as said first large interior compartment and divided therefrom by an interior dividing wall, the second interior compartment sharing a portion of the interior surface of the first large interior compartment and a second opening in said exterior surface leading only to said second interior compartment;

e. means to open and close said second opening in said exterior surface leading to said second interior compartment; and f. a rollable mat made of the same material as said exterior surface, the rollable mat having a first end and a second end, and the rollable mat permanently affixed at its first end to said interior surface of said first large compartment so that the mat can be rolled into said second interior compartment and retained therein and segregated from the first large interior compartment, and the rollable mat can be unrolled and extend out of the second interior compartment and through said second opening so that the rollable mat lays flat against said sports bag with its second end extending farthest away from the sports bag.

2. The sports bag as defined in claim 1 wherein said means to open and close said first opening is a zipper.

3. The sports bag as defined in claim 1 wherein said means to open and close said second opening is a zipper.

4. The sports bag as defined in claim 1 wherein said mat is generally rectangular in configuration.

5. The sports bag as defined in claim 1 wherein said sports bag is in the shape of a duffle bag.

6. The sports bag as defined in claim 1 wherein said exterior surface of said sports bag and said mat are both made out of flexible synthetic material.

7. A sports bag comprising:

a. exterior surface made of material and a first large interior compartment for retaining sports items, the first large interior compartment extending for a given interior length and having an interior surface;

b. said exterior surface having a first opening leading to the first large interior compartment;

c. means to open and close said first opening in said exterior surface leading to said first large interior compartment;

d. a second interior compartment retained within said first large interior compartment, extending for substantially the same length as said first large interior compartment and divided therefrom by an interior dividing wall, the second interior compartment sharing a portion of the interior surface of the first large interior compartment, and a second opening in said exterior surface leading only to said second interior compartment;

e. means to open and close said second opening in said exterior surface leading to said second interior compartment; and f. a rollable mat made of the same material as said exterior surface, the rollable mat having a first end and a second end, and the rollable mat removably affixed at its first end to said interior surface of said first large compartment so that the mat can be rolled into said second interior compartment and retained therein and segregated from the first large interior compartment, and the rollable mat can be unrolled and extend out of the second interior compartment and through said second opening so that the rollable mat lays flat against said sports bag with its second end extending farthest away from the sports bag.

8. The sports bag as defined in claim 7 wherein said means to open and close said first opening is a zipper.

9. The sports bag as defined in claim 7 wherein said means to open and close said second opening is a zipper.

10. The sports bag as defined in claim 7 wherein said mat is generally rectangular in configuration.

11. The sports bag as defined in claim 7 wherein said sports bag is in the shape of a duffle bag.

12. The sports bag as defined in claim 7 wherein said exterior surface of said sports bag and said mat are both made out of flexible synthetic material.

13. The sports bag as defined in claim 7 wherein said rollable mat is removably affixed by means of mating hook and loop attachment members, with one attachment member affixed to the interior surface of said first large interior compartment of said sports bag and the other attachment member attached to said first end of said rollable mat.

* * * * *